United States Patent [19]

Rajacich

[11] Patent Number: 4,650,189

[45] Date of Patent: Mar. 17, 1987

[54] RECREATIONAL PRACTICE APPARATUS FOR REBOUNDING BALLS

[76] Inventor: Joseph Rajacich, 6763 Rollingwood Dr., Clemmons, N.C. 27012

[21] Appl. No.: 610,121

[22] Filed: May 14, 1984

Related U.S. Application Data

[63] Continuation of Ser. No. 317,833, Nov. 3, 1981, abandoned.

[51] Int. Cl.[4] ..... A63B 69/40

[52] U.S. Cl. ..... 273/26 A; 273/395

[58] Field of Search ..... 273/26 A, 29 A, 30, 273/411, 73 L, 400, 407, 395, 342

[56] References Cited

U.S. PATENT DOCUMENTS

| | | | |
|---|---|---|---|
| 2,247,657 | 7/1941 | Girden | 273/30 |
| 2,944,816 | 7/1960 | Dixon | 273/29 A |
| 3,013,801 | 12/1961 | Kirkconnell, Jr. | 273/29 A |
| 3,427,026 | 2/1969 | Mahoney | 273/29 A |
| 3,583,703 | 6/1971 | Brown | 273/29 A |
| 3,633,909 | 1/1972 | Doynow | 273/29 A |
| 3,672,672 | 6/1972 | Rubin | 273/29 A |
| 3,706,451 | 12/1972 | Dixon | 273/29 A |
| 4,457,513 | 7/1984 | Thompson | 273/342 |

OTHER PUBLICATIONS

"The Sporting Goods Dealer", p. 121, Jul. 1974.

*Primary Examiner*—Richard C. Pinkham
*Assistant Examiner*—T. Brown
*Attorney, Agent, or Firm*—B. B. Olive

[57] ABSTRACT

The apparatus of the invention relates to a recreational apparatus for rebounding balls, and the like, thrown against it. The apparatus is constructed comprising three net planes and four playing surfaces so that two players may simultaneously use the apparatus by playing on opposite sides thereof. The frame has horizontal bars and side legs and can be separated into portions for breakdown purposes. Each of the three net sections is attached to the frame by spaced resilient members.

1 Claim, 6 Drawing Figures

RECREATIONAL PRACTICE APPARATUS FOR REBOUNDING BALLS

CROSS-REFERENCE TO RELATED APPLICATION

This application is a continuation application of applicant's copending patent application Ser. No. 317,833, filed Nov. 3, 1981 (abandoned), entitled "Baseball Practice Partner".

TECHNICAL FIELD

This invention relates to a recreational apparatus for rebounding balls, and the like, thrown against it. More particularly, this invention relates to a ball-return apparatus utilized by ball players and children to resiliently rebound a ball thrown thereagainst at a given direction and angle depending on which portion of the apparatus is impacted by the ball.

BACKGROUND ART

Numerous types of rebound apparatus are known to the prior art comprised of various frame and net configurations. For example, U.S. Pat. No. 3,427,026 to Mahoney teaches a single-plane net, adjustably secured to a base frame. U.S. Pat. No. 2,944,816 to Dixon also teaches recreational apparatus comprising a single-plane net adjustably secured to a base means. Other prior art includes U.S. Pat. No. 3,836,144 to Mahoney which teaches a portable projectile return apparatus having a single-plane net which can be adjusted relative to a collapsible base. U.S. Pat. No. 3,672,672 to Rubin discloses a ball-rebound device comprising a single-plane net secured within a frame and having an impact-actuated bell mounted therebehind. U.S. Pat. No. 3,706,451 to Dixon discloses a target-type scoring device providing a single-plane net surrounding a target and having a scoring indicator positioned therebehind. U.S. Pat. No. 4,148,555 to Lerman discloses another single-plane net having a target positioned therein and a score indicator being triggered from behind the target.

Still other prior art includes U.S. Pat. No. 2,247,657 to Girden which teaches a horizontal ping-pong-type table having an upright wall and angle board positioned thereon for rebounding and U.S. Pat. No. 3,711,092 to Hogue which teaches a rebounding apparatus comprising a single-plane net having a nylon cord tensioning element interlaced therein and connected to the frame. Applicant also is informed that Franklin Industries of Stoughton, Mass., manufactures and sells a "Championship Three-Way Pitch and Field" apparatus comprising three single-plane net sections forming a substantially curvilinear net surface supported by an anchored frame structure and having only one usable side.

DISCLOSURE OF THE INVENTION

This invention relates to a baseball or softball rebound apparatus having three net sections in three different planes so as to be simultaneously usable by one or more players on opposing sides of the apparatus to return, for example, baseballs or softballs thrown thereagainst in order to practice play making or to practice baseball and softball pitching and catching in order to improve accuracy and reflexes.

An important object of the present invention is to provide a novel rebound apparatus for individual practice of baseball and softball pitching and catching.

It is another object of the present invention to provide a novel baseball and softball practice apparatus which can receive pitches of high velocity and return balls at higher velocities than can be accomplished by presently-known apparatus.

It is a further object of the present invention to provide a baseball and softball rebound apparatus which can be utilized simultaneously by two players.

It is a still further object of the present invention to provide a baseball and softball rebound apparatus which can be quickly assembled and disassembled without the use of nuts, bolts, clamps, or the like.

These and other objects of the present invention will be more readily understood by reference to the following specification taken in conjunction with the accompanying drawings, in which:

BEST MODE FOR CARRYING OUT THE INVENTION

Figure 5:
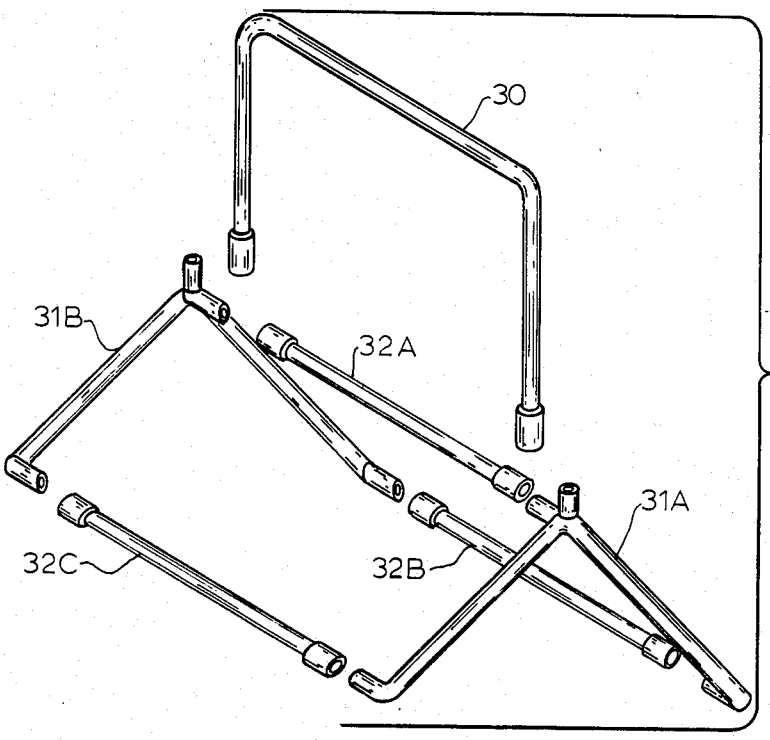
FIG. 5 is an exploded view of the frame elements of the apparatus of the present invention.
Figure 6:
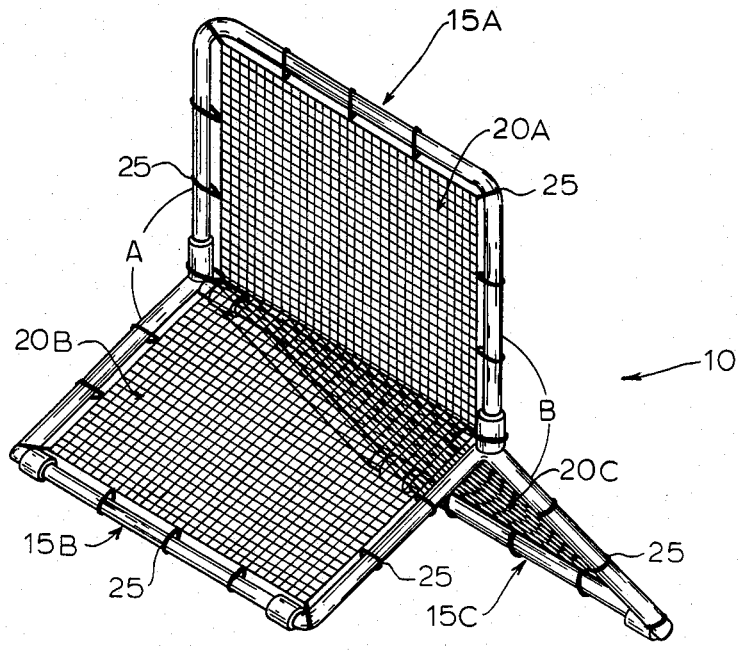
FIG. 6 is a perspective view of the apparatus of the present invention in its fully-assembled form.

Referring now to the drawings, FIG. 6 depicts the baseball and softball rebound apparatus of the present invention in its fully-assembled form. More particularly, the rebound apparatus 10 includes a frame comprising an upright section 15A and two bottom support sections 15B and 15C. As can be clearly seen in FIGS. 5 and 6, lower sections 15B and 15C depend downwardly from upper section 15A and diverge from each other in order to support the apparatus and render it capable of withstanding the impact of balls pitched at a high velocity. Provided within three rectangular sections 15A, 15B, 15C defined by the tubular frame is a net structure. The net structure is comprised of three rectangular net sections 20A, 20B and 20C, each being positioned within a corresponding section of the frame. The net structure is secured in a taut condition within the frame by rubber strips 25.

The frame is preferably constructed of fourteen gauge, one and one-half inch diameter tubular steel although other metals of differing gauges and forms may be utilized as a matter of design choice. The three net sections 20A, 20B, 20C are preferably constructed of nylon mesh having one and seven-eighths inch square mesh although other materials and other sizes of mesh may be utilized, including tightly-constructed materials.

Figure 1:
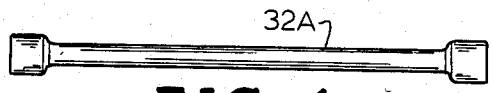
FIG. 1 is a plan view of one of the crossbar elements of the present invention.
Figure 2:
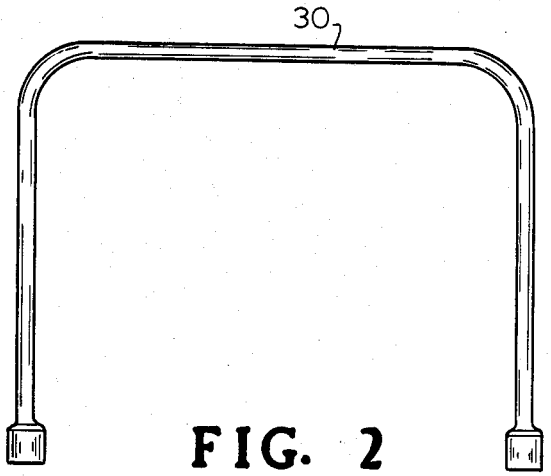
FIG. 2 is a front elevational view of the inverted U-member of the present invention.
Figure 3:
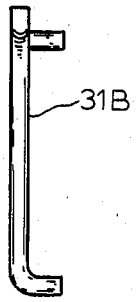
FIG. 3 is a front elevational view of a leg member of the present invention.
Figure 4:
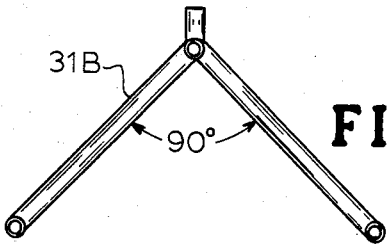
FIG. 4 is a side elevational view of the leg member of FIG. 3.

FIG. 5 illustrates that the preferred embodiment of the frame of the present invention comprises six sections of tubular pipe which can be assembled into a unit by sliding the telescoping parts together. As best shown in FIG. 5, the six tubular pipe sections forming the frame include U-member 30 (also shown in FIG. 2), legs 31A, 31B (31B also shown in FIGS. 3 and 4), and crossbars 32A, 32B, 32C (32A also shown in FIG. 1). Crossbars 32B, 32C support the frame on the ground or other support surface. The frame may be spray painted a desirable color either before or after assembly thereof.

It should be clearly understood, as best seen in FIG. 6, that the baseball and softball rebound apparatus of the present invention comprises three net sections 20A, 20B, 20C with net section 20A being positioned upright and vertical to the ground or other support surface for the apparatus and net sections 20B, 20C extend downwardly and divergently from one another as they approach the ground or support surface. Net sections 20A, 20B, 20C are contained within corresponding frame sections 15A, 15B, 15C. Furthermore, frame sections 15B, 15C are, preferably, positioned perpendicularly, i.e., at 90° (FIG. 4), to each other and serve as a base or support means for the rebound apparatus so as to render it stable and capable of withstanding the impact of balls pitched at high velocity. Included angles A and B are formed as obtuse angles as in FIG. 6.

Preferably, net sections 20A, 20B, 20C are attached to the frame with rubber straps 25 (FIG. 6). Rubber straps 25 may be three-quarter inch straps securing the net to the frame with a strap utilized for each section of mesh adjacent to the frame while only a representative number of straps have been shown for purposes of illustration. Another method of attaching net sections 20A, 20B, 20C to the frame would be by means of springs, each of which would be attached at one end to the net and at the other end to the frame.

It is contemplated that frame elements 30, 31A, 31B, and 32A, 32B, 32C may be constructed by bending tubular metal pipe to the proper configuration by use of a hydraulic device and then expanding the ends of the pipes and welding the tubular pipe as necessary. Through the use of this type of construction, the apparatus of the invention is fabricated so as not to require nuts, bolts, clamps, or similar assembly devices. This reduces the time necessary for assembly and disassembly of the frame by the user and eliminates unnecessary parts which may loosen, break or be lost.

In operation, the net sections 20A, 20B, 20C provide three planes and four playing surfaces so as to enable two players to use the apparatus simultaneously by playing on opposing sides thereof. It is understood that the four playing surfaces comprise both sides of upright vertical net section 20A and the outwardly facing side of net section 20B and 20C. The use of rubber straps 25 for securing the net sections 20A, 20B, 20C to the frame enables the apparatus of the present invention to rebound softballs, baseballs, and the like, at a higher velocity than previously possible with prior art rebound apparatus.

While there has been disclosed what at present is considered to be the preferred embodiment of the present invention, it will be understood that various modifications and alterations may be made thereto without departing from the true spirit and scope of the present invention and it is intended to cover in the appended claims all such modifications and alterations.

What is claimed is:

1. A recreational apparatus for rebounding balls, and the like, comprising:

(a) a tubular-formed frame, comprising:

(i) a first frame section formed by a first top horizontal bar and a first pair of parallel legs extending vertically downwardly from opposite ends of said bar and defining a first vertical rectangular plane within the boundaries thereof;

(ii) a second frame section formed by a second bottom horizontal bar parallel to said first top bar and supporting said frame and a second pair of parallel legs angled upwardly from opposite ends of said second bottom bar and connected to said first pair of legs of said first frame section, said seoond frame section defining a second rectangular plane within the boundaries thereof which forms an externsion of said first vertical plane and with the included angle between said first and second planes being an obtuse angle; and (iii) a third frame section formed by a third bottom horizontal bar parallel to said first and second bars and supporting said frame and a third pair of parallel legs angled upwardly from opposite ends of said third bottom bar and connected to both the first and second pair of said legs, said third frame section defining a third rectangular plane within the boundaries thereof which forms an extension of said first vertical plane and with the included angle between said first and third planes being an obtuse angle;

(b) means forming selected portions of said frame sections enabling detachable connection and breakdown disassembly thereof;

(c) a net structure comprising:

(i) a first net section of less area than and residing in said first rectangular plane and having its periphery located in spaced relation to said first top bar and first pair of legs;

(ii) a second net section of less area than and residing in said second rectangular plane, said second net section forming an extension of said first net section and having its periphery located in spaced relation to said second bottom bar and second pair of legs; and (iii) a third net section of less area than and residing in said third rectangular plane, said third net section also forming an extension of said first net section and having its periphery located in spaced relation to said third portion bar and third pair of legs; and (d) a plurality of resilient members attached to each of said frame sections in spaced relation on the respective bar and legs forming each said section, said resilient members being connected to said net sections around the peripheries thereof adjacent the respective bar and leg members supporting each such net section.

* * * * *